US011293249B2

(12) United States Patent
Wright

(10) Patent No.: US 11,293,249 B2
(45) Date of Patent: Apr. 5, 2022

(54) ROTATING SPLIT TUBING HANGER

(71) Applicant: RISUN OILFLOW SOLUTIONS INC., Nisku (CA)

(72) Inventor: Andrew Wright, Nisku (CA)

(73) Assignee: RISUN OILFLOW SOLUTIONS INC., Nisku (CA)

( * ) Notice: Subject to any disclaimer, the term of this patent is extended or adjusted under 35 U.S.C. 154(b) by 50 days.

(21) Appl. No.: 15/571,559

(22) PCT Filed: May 5, 2016

(86) PCT No.: PCT/CA2016/050518
§ 371 (c)(1),
(2) Date: Nov. 3, 2017

(87) PCT Pub. No.: WO2016/176774
PCT Pub. Date: Nov. 10, 2016

(65) Prior Publication Data

US 2018/0148990 A1 May 31, 2018

Related U.S. Application Data

(60) Provisional application No. 62/157,208, filed on May 5, 2015.

(51) Int. Cl.

| | |
|---|---|
| ***E21B 33/04*** | (2006.01) |
| ***E21B 4/00*** | (2006.01) |
| ***E21B 19/02*** | (2006.01) |

(52) U.S. Cl.
CPC ..... *E21B 33/0415* (2013.01); *E21B 4/003* (2013.01); *E21B 19/02* (2013.01)

(58) Field of Classification Search
CPC ..... E21B 33/0415
See application file for complete search history.

(56) References Cited

U.S. PATENT DOCUMENTS

| | | | |
|---|---|---|---|
| 4,995,457 | A | 2/1991 | Baldridge |
| 5,465,788 | A | 11/1995 | Wright |

(Continued)

FOREIGN PATENT DOCUMENTS

| | | |
|---|---|---|
| CA | 2845974 | 9/2015 |
| CA | 2941404 | 11/2016 |

OTHER PUBLICATIONS

"Tubing hanger" definition from Collins Dictionary. Available from: https://www.collinsdictionary.com/dictionary/english/tubing-hanger (Year: 2020).*

(Continued)

*Primary Examiner* — Blake Michener
*Assistant Examiner* — Theodore N Yao
(74) *Attorney, Agent, or Firm* — Foley & Lardner LLP

(57) ABSTRACT

There is provided a rotating split tubing hanger, including: a mandrel having a bore therein and a mandrel exterior surface, the mandrel attachable to a tubing string; a housing sleeve mountable on the exterior surface of the mandrel, the mandrel being rotatable relative to the housing sleeve, and the housing sleeve comprising a housing sleeve exterior surface; and an outer sleeve removably mountable on the housing sleeve exterior surface, the outer sleeve comprising an outer sleeve exterior support surface engageable with a tubing head.

20 Claims, 9 Drawing Sheets

(56) References Cited

U.S. PATENT DOCUMENTS

| | | | | |
|---|---|---|---|---|
| 5,732,777 | A * | 3/1998 | Grimshaw | E21B 33/0415 166/382 |
| 6,640,892 | B1 * | 11/2003 | Wright | E21B 33/0415 166/68.5 |
| 7,306,031 | B2 | 12/2007 | Wright et al. | |
| 7,448,444 | B2 | 11/2008 | Thomson et al. | |
| 8,272,434 | B2 | 9/2012 | Garcia | |
| 2007/0175625 | A1 | 8/2007 | Lam | |
| 2011/0226488 | A1 * | 9/2011 | Garcia | E21B 33/0415 166/382 |
| 2012/0085552 | A1 | 4/2012 | Travis et al. | |
| 2013/0181844 | A1 * | 7/2013 | Hurst | E21B 43/127 340/854.6 |
| 2013/0319688 | A1 * | 12/2013 | Moellendick | E21B 33/0415 166/382 |
| 2014/0262342 | A1 | 9/2014 | Obrejanu | |
| 2015/0041151 | A1 * | 2/2015 | Cocker, III | E21B 33/14 166/380 |
| 2015/0152701 | A1 * | 6/2015 | Levert, Jr. | E21B 33/04 166/380 |
| 2016/0160576 | A1 * | 6/2016 | Obrejanu | E21B 17/05 166/380 |
| 2017/0218724 | A1 * | 8/2017 | Brasseaux | E21B 43/045 |

OTHER PUBLICATIONS

U.S. Appl. No. 16/481,952, filed Jul. 30, 2019, Wright.

International Search Report and Written Opinion for International (PCT) Patent Application No. PCT/CA2018/050107, dated May 1, 2018, 10 pages.

International Search Report and Written Opinion prepared by the Canadian Intellectual Property Office prepared on Aug. 12, 2016, for International Application No. PCT/CA2016/050518.

International Preliminary Report on Patentability, Ch. I, for PCT/CA2016/050518 dated Nov. 16, 2017 (7 pages).

* cited by examiner

ROTATING SPLIT TUBING HANGER

CROSS REFERENCE TO RELATED APPLICATIONS

This application is a national stage application under 35 U.S.C. 371 and claims the benefits of PCT Application No. PCT/CA2016/050518 having an international filing date of 5 May 2016, which designated the United States, which PCT application claimed the benefit of U.S. Provisional Patent Application No. 62/157,208, filed May 5, 2015, the disclosures of which are incorporated herein by reference.

TECHNICAL FIELD

The invention relates to rotating tubing hangers and more particularly to split tubing hangers.

BACKGROUND

Tubing hangers are used to suspend a tubing string in a hydrocarbon well from a tubing head, which may either be part of the wellhead or mounted above the wellhead. A tubing hanger generally supports the weight of the tubing string, and prevents the tubing string from being raised out from the wellbore. Tubing hangers restrict the tubing string from being positioned above the well head. Thus to perform service on the tubing string, the tubing hanger must be removed, a costly and time consuming endeavour.

Split tubing hangers are also used to suspend a tubing string in a hydrocarbon well from the tubing head. A split tubing hanger generally supports the weight of the tubing string, but does not prevent the tubing string from being raised out from the wellbore. The split tubing hanger includes one piece mandrel that has a removable tubing outer sleeve that is connected and pinned in place. The split tubing hanger thus allows the tubing string to be lowered below the well head to do service work, which typically requires rotating, circulating and reciprocating with the split tubing hanger portion of the tubing string.

SUMMARY

According to an embodiment of the invention, a rotating split tubing hanger is provided including a mandrel, a housing sleeve for bearing axial and rotary loads, and an outer sleeve removably mounted to the mandrel. The outer sleeve has a support surface that extends radially outward relative to the mandrel, the support surface being sized to engage a tubing head and support the mandrel against downward axial movement. A housing sleeve inner surface is provided between the mandrel and the housing sleeve, the housing sleeve inner surface supporting bearings permitting rotation of the mandrel relative to the housing sleeve and outer sleeve.

According to another aspect, the housing sleeve may have a first connecting portion, and the outer sleeve has a second connecting portion on an inner surface of the outer sleeve that is complementary to the first connecting portion.

According to another aspect, the first and second connecting portions may include first and second threaded portions, respectively. The outer sleeve may include stops that engage the housing sleeve to prevent relative rotation of the first and second threaded portions. The outer sleeve may be removable from the housing sleeve and mandrel, and may be interchangeable with other tubing well heads.

According to another aspect, the housing sleeve inner surface may support one or more bearing races. The bearing races may be housed within the housing sleeve and/or the mandrel.

According to another aspect, the rotating split tubing hanger may further include a rotational control element, such as a ratchet, positioned at the mandrel and the housing sleeve that permits rotation of the mandrel in a single direction relative to the outer sleeve.

According to another aspect, the outer sleeve may have an outer surface adapted to form a positive seal against pressure when installed in the tubing head.

According to another aspect, there is provided a method of hanging tubing in a hydrocarbon well, the method including the steps of: using a rotating split tubing hanger as described herein, connecting the mandrel to a tubing string and inserting the tubing string into the hydrocarbon well such that the rotating split tubing hanger is supported by a tubing head; permitting the mandrel to rotate with the tubing string; lifting the rotating split tubing hanger out of engagement from the tubing head; disconnecting the outer sleeve from a housing sleeve and/or mandrel; and lowering the housing sleeve and/or mandrel and the tubing string into the hydrocarbon well.

According to another aspect, the method may further include the step of disconnecting an outer sleeve from the housing sleeve and/or mandrel when the mandrel is above the tubing head, thereby providing access to the tubing string below the tubing head. The outer sleeve may be replaced by a protective sleeve to prevent damage to the threading during service operations. Maintenance may be performed with the tubing string after removal of the outer sleeve.

According to another embodiment of the invention a rotating split tubing hanger is provided including: a mandrel; an outer sleeve removably mounted to a housing sleeve, the outer sleeve having a support surface that extends radially outward relative to the housing sleeve, the support surface being sized to engage a tubing head and support the mandrel against downward axial movement; and wherein the housing sleeve inner surface is configured to permit rotation of the mandrel relative to the housing sleeve and outer sleeve.

According to another aspect, the rotating split tubing hanger may include a stop that is engageable with the housing sleeve to prevent relative rotation of the first and second threaded portions.

According to another aspect, the mandrel may be one piece.

According to another embodiment of the invention a rotating split tubing hanger is provided, including: a mandrel having a bore therein and a mandrel exterior surface, the mandrel attachable to a tubing string; a housing sleeve mountable on the exterior surface of the mandrel, the mandrel being rotatable relative to the housing sleeve, and the housing sleeve including a housing sleeve exterior surface; and an outer sleeve removably mountable on the housing sleeve exterior surface, the outer sleeve including an outer sleeve exterior support surface engageable with a tubing head. The outer sleeve may include an outer sleeve interior surface reversibly mateable with the housing sleeve exterior surface. One or more bearings may be positioned between the mandrel and the housing sleeve to facilitate rotation of the mandrel within the housing sleeve. The one or more bearings may include one or more bearing races.

According to another aspect, a rotation control assembly may be positioned between the mandrel and the housing sleeve for limiting rotation of the mandrel relative to the housing sleeve to a single direction. The rotation control assembly may include a ratchet assembly. The ratchet assembly may include a first control surface attached to the mandrel and a second control surface attached the housing sleeve, the first and second control surfaces configured to rotate only in a single direction only with respect to each other when the first and second control surfaces are engaged. The first and second control surfaces may include interlocking teeth with a sloped side and a vertical side, rotation being allowed in one direction by the sloped sides sliding along each other, while the vertical sides engage and prevent rotation in the other direction. Alternatively, the second control surface may include a pin. The rotation control assembly may include a spring that exerts a biasing force against the first control surface towards the second control surface.

According to another aspect, the outer sleeve interior surface and the housing sleeve exterior surface may include respective first and second threaded portions. The rotating split tubing hanger may include rotational stops mounted on the outer sleeve that are engageable with the housing sleeve to prevent relative rotation of the first and second threaded portions. The mandrel may be one piece and further include an upper portion having internal tubing string pickup threads. The mandrel may include a lower portion having threads for engaging the tubing string.

According to another aspect the outer sleeve exterior support surface may extend radially outward relative to the mandrel to support the tubing hanger against downward axial movement when the outer sleeve exterior support surface engages the tubing head.

According to another embodiment of the invention, a rotating split tubing hanger for rotatably suspending a tubing string within a well having a tubing head and downhole pump situated within the well is provided, including: a mandrel having a bore therein and an exterior surface, the mandrel configured to be operatively attached to the tubing string so that the bore is in fluid communication with an interior of the tubing string; a housing sleeve mountable on the exterior surface of the mandrel, the mandrel being rotatable relative to the housing sleeve so that a rotational torque applied to the tubing string through operation of the downhole pump is transferred to the mandrel and the mandrel is rotated with respect to the housing sleeve, and the housing sleeve includes a housing sleeve exterior surface; and an outer sleeve removably mountable on the housing sleeve, the outer sleeve having a first connecting portion formed on an interior surface of the outer sleeve, the first connecting portion configured to reversibly mate with a second connecting portion formed on an exterior surface of the housing sleeve, and the outer sleeve further including an exterior support surface that is configured to engage the tubing head and support the tubing string against downward axial movement.

According to another aspect, the rotating split tubing hanger may include one or more bearings positioned between the mandrel and the housing sleeve, the one or more bearings facilitating rotation of the mandrel within the housing sleeve. The one or more bearings may include one or more bearing races.

The rotating split tubing hanger may include a ratchet having first and second control surfaces, the first control surface including teeth with a sloped side and a vertical side, and the second control surface including at least one pin, such that rotation is allowed in one direction by the sloped side sliding along the pin, while the vertical side engages the pin and prevents rotation in the other direction.

According to another embodiment of the invention, a method of rotatably suspending a tubing string within a well containing a downhole pump is provided, the method including: attaching a mandrel to the tubing string and inserting the tubing string into the well; permitting rotation of the mandrel with respect to a housing sleeve mounted to the mandrel so that a rotational torque applied to the tubing string through the operation of the downhole pump is transferred to the mandrel; removably attaching an outer sleeve to the housing sleeve using a first connecting portion formed on an interior surface of the outer sleeve, the first connection portion configured to reversibly mate with a second connecting portion formed on an exterior surface of the housing sleeve; and suspending the tubing string from the tubing head with the outer sleeve, the outer sleeve having an exterior support surface that is configured to engage a tubing head of the well and support the tubing string against downward axial movement.

According to another aspect, the first and second connecting portions may include first and second threaded portions, respectively, which are fitted together by rotation of the outer sleeve with respect to the housing sleeve. The rotation of the mandrel can be limited with respect to the housing sleeve to a single direction only.

According to another aspect, the well can be accessed for servicing by lifting the split tubing hanger out of engagement with a tubing head of the well, disconnecting the outer sleeve from the housing sleeve by separating the first connecting portion from the second connecting portion, and lowering the mandrel, the housing string, and the tubing string into the well. A protective sleeve may be provided to prevent thread damage to the housing sleeve after disconnecting the outer sleeve from the housing sleeve.

According to another aspect, a rotational indicator may be provided, which may be a magnet positioned in a ring on the mandrel.

In other aspects, the features described above may be combined together in any reasonable combination as will be recognized by those skilled in the art.

BRIEF DESCRIPTION OF THE DRAWINGS

These and other features will become more apparent from the following description in which reference is made to the appended drawings, the drawings are for the purpose of illustration only and are not intended to be in any way limiting, wherein.

DETAILED DESCRIPTION

Figure 1:
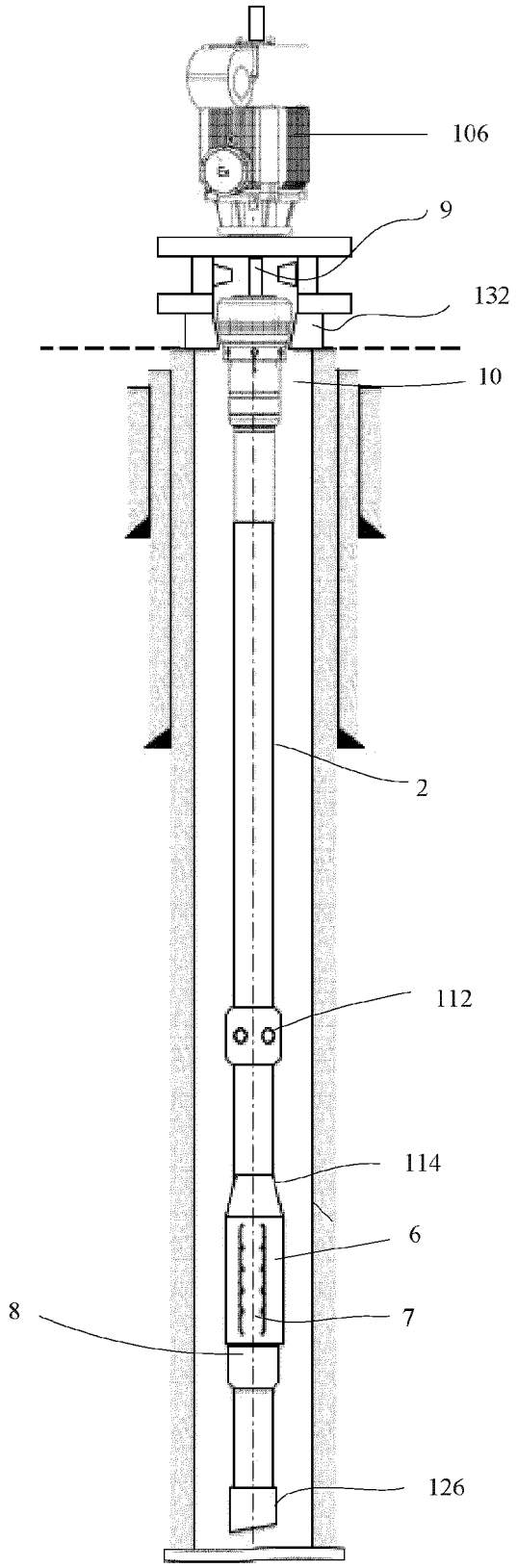
FIG. 1 is a cross sectional view of a tubing string according to an embodiment of the invention.

A detailed description of one or more embodiments of the invention is provided below along with accompanying figures that illustrate the principles of the invention. The invention is described in connection with such embodiments, but the invention is not limited to any embodiment. The scope of the invention is limited only by the claims and the invention encompasses numerous alternatives, modifications and equivalents. Numerous specific details are set forth in the following description in order to provide a thorough understanding of the invention. These details are provided for the purpose of example and the invention may be practiced according to the claims without some or all of these specific details. For the purpose of clarity, technical material that is known in the technical fields related to the invention has not been described in detail so that the invention is not unnecessarily obscured.

The term "invention" and the like mean "the one or more inventions disclosed in this application", unless expressly specified otherwise.

The terms "an aspect", "an embodiment", "embodiment", "embodiments", "the embodiment", "the embodiments", "one or more embodiments", "some embodiments", "certain embodiments", "one embodiment", "another embodiment" and the like mean "one or more (but not all) embodiments of the disclosed invention(s)", unless expressly specified otherwise.

The term "variation" of an invention means an embodiment of the invention, unless expressly specified otherwise.

A reference to "another embodiment" or "another aspect" in describing an embodiment does not imply that the referenced embodiment is mutually exclusive with another embodiment (e.g., an embodiment described before the referenced embodiment), unless expressly specified otherwise.

The terms "including", "comprising" and variations thereof mean "including but not limited to", unless expressly specified otherwise.

The terms "a", "an" and "the" mean "one or more", unless expressly specified otherwise. The term "plurality" means "two or more", unless expressly specified otherwise. The term "herein" means "in the present application, including anything which may be incorporated by reference", unless expressly specified otherwise.

The term "e.g." and like terms mean "for example", and thus does not limit the term or phrase it explains.

The term "respective" and like terms mean "taken individually". Thus if two or more things have "respective" characteristics, then each such thing has its own characteristic, and these characteristics can be different from each other but need not be. For example, the phrase "each of two machines has a respective function" means that the first such machine has a function and the second such machine has a function as well. The function of the first machine may or may not be the same as the function of the second machine.

Where two or more terms or phrases are synonymous (e.g., because of an explicit statement that the terms or phrases are synonymous), instances of one such term/phrase does not mean instances of another such term/phrase must have a different meaning. For example, where a statement renders the meaning of "including" to be synonymous with "including but not limited to", the mere usage of the phrase "including but not limited to" does not mean that the term "including" means something other than "including but not limited to".

Neither the Title (set forth at the beginning of the first page of the present application) nor the Abstract (set forth at the end of the present application) is to be taken as limiting in any way the scope of the disclosed invention(s). An Abstract has been included in this application merely because an Abstract of not more than 150 words is required under 37 C.F.R. Section 1.72(b) or similar law in other jurisdictions. The title of the present application and headings of sections provided in the present application are for convenience only, and are not to be taken as limiting the disclosure in any way.

Numerous embodiments are described in the present application, and are presented for illustrative purposes only. The described embodiments are not, and are not intended to be, limiting in any sense. The presently disclosed invention(s) are widely applicable to numerous embodiments, as is readily apparent from the disclosure. One of ordinary skill in the art will recognize that the disclosed invention(s) may be practiced with various modifications and alterations, such as structural and logical modifications. Although particular features of the disclosed invention(s) may be described with reference to one or more particular embodiments and/or drawings, it should be understood that such features are not limited to usage in the one or more particular embodiments or drawings with reference to which they are described, unless expressly specified otherwise.

A rotating split tubing hanger generally identified by reference numeral 10, will now be described with reference to FIGS. 1 through 14.

Figure 2:
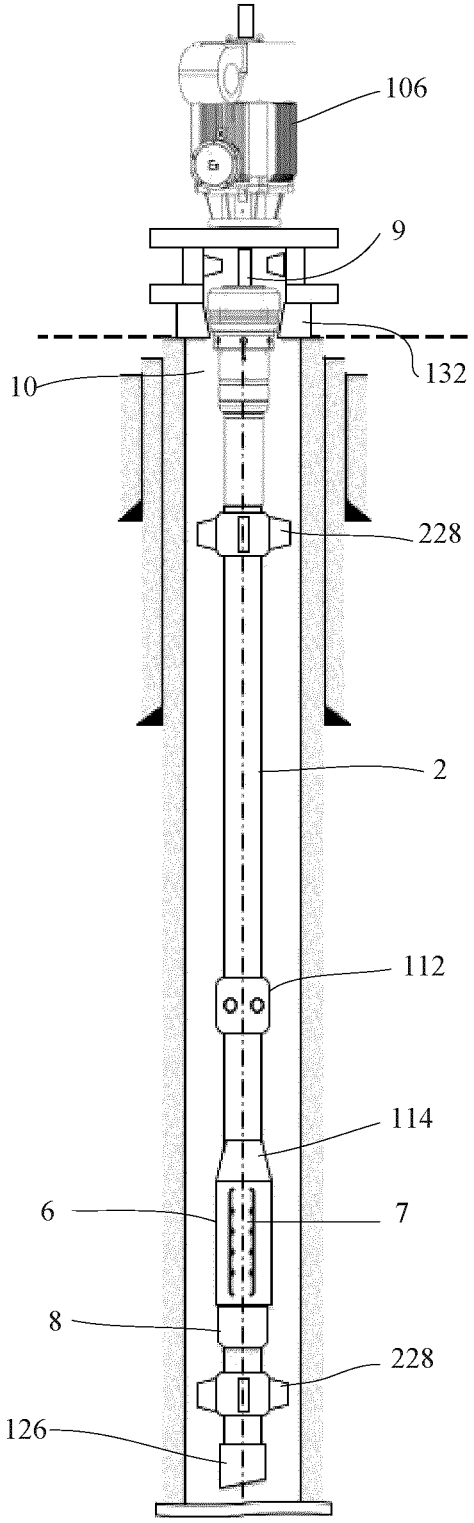
FIG. 2 is a cross sectional view of a tubing string according to an embodiment of the invention including a centralizer.

Referring to FIGS. 1 and 2 there is shown in cross-section of an oil well according to the invention in production mode. The well includes a well casing extending from the surface of the ground down into the oil bearing strata. The casing maintains the well in an open condition and prevents caving and sloughing of material into the well. Tubing string 2 is situated within the casing and is hung within the well by rotating split tubing hanger 10. A variety of different types of production equipment may be positioned upon the wellhead above rotating split tubing hanger 10, including well head drive 106. Pump rod 9 extends from drive 106 through tube string 2.

Tubing drain 112 is positioned in tubing string 2 below rotating split tubing hanger 10. Cross over adaptor 114 is positioned just above pump 6, which is above rotor tag bar 8. Tubing string 2 ends at tail joint 126. Alternatively, and as shown in FIG. 2, a rotating tubing centralizer 228 may be positioned above tubing drain 112 and a second rotating tubing centralizer 228 below pump 6.

Downhole pump 6 (which may be a progressive cavity, rotary, screw or other form of pump) is connected to the lower end of production tubing string 2. Pump 6 may include stator 7 and rotor 8 that is turned by means of a rotating pump rod 9 extending from a surface drive system down through the production tubing string 2 (although it will be appreciated that other forms or methods of operating the pump could also be employed while remaining within the scope of the invention).

As the rotor 8 in pump 6 is turned by pump rod 9, an element of rotational torque (which can vary but may be as high as 3000 foot-pounds) is imparted to the stator 7, which will in turn be transmitted to the tubing string 2 to rotating split tubing hanger 10. Rotating split tubing hanger 10 uses that rotational energy applied to the tubing string 2 to permit the string 2 to rotate so that erosion and wear of the string 2 is evenly distributed about its inner surface. Through harnessing the rotational energy applied to the tubing string 2, rotating split tubing hanger 10 does not need to rely upon external sources of mechanical, hydraulic or electromechanical power.

Figure 3:
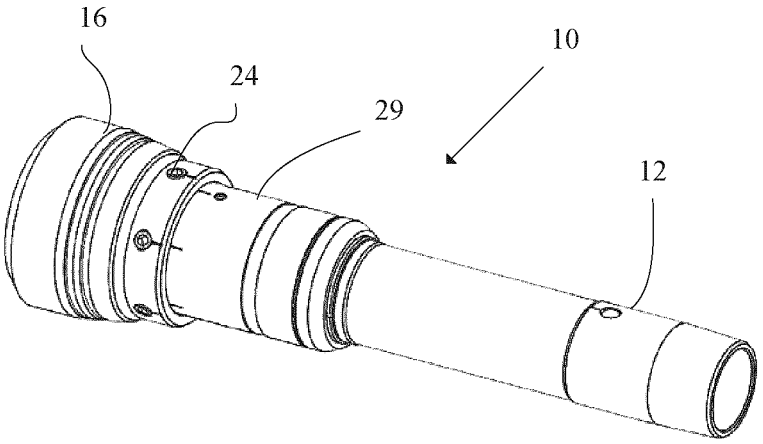
FIG. 3 is a perspective view of an embodiment of a rotating split tubing hanger according to the invention.
Figure 4:
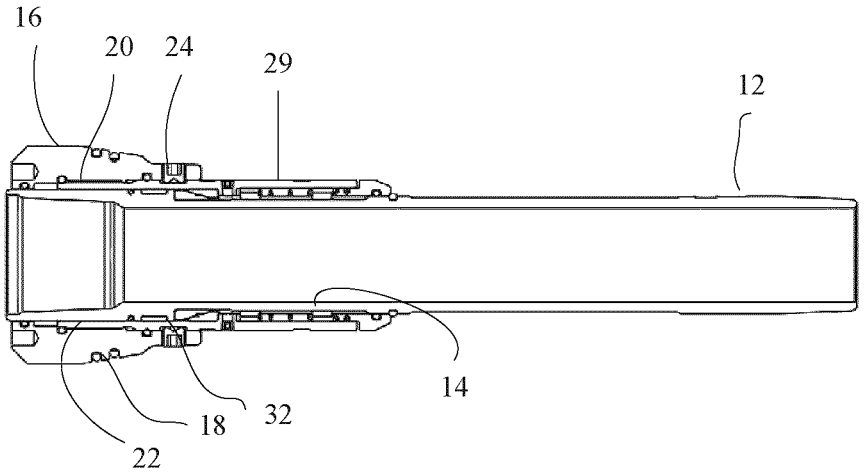
FIG. 4 is a cross sectional view of the rotating split tubing hanger of FIG. 3.
Figure 5:
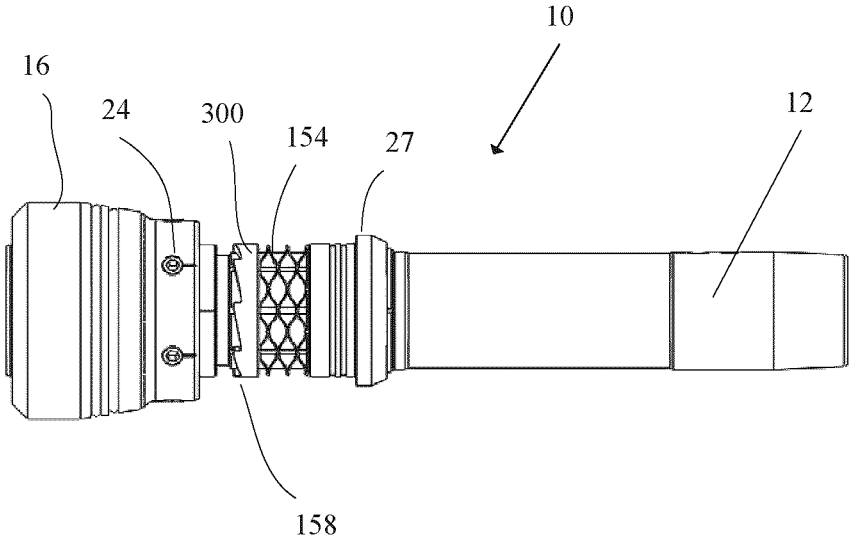
FIG. 5 is a partially cutaway side elevation view of the rotating split tubing hanger of FIG. 3.
Figure 13:
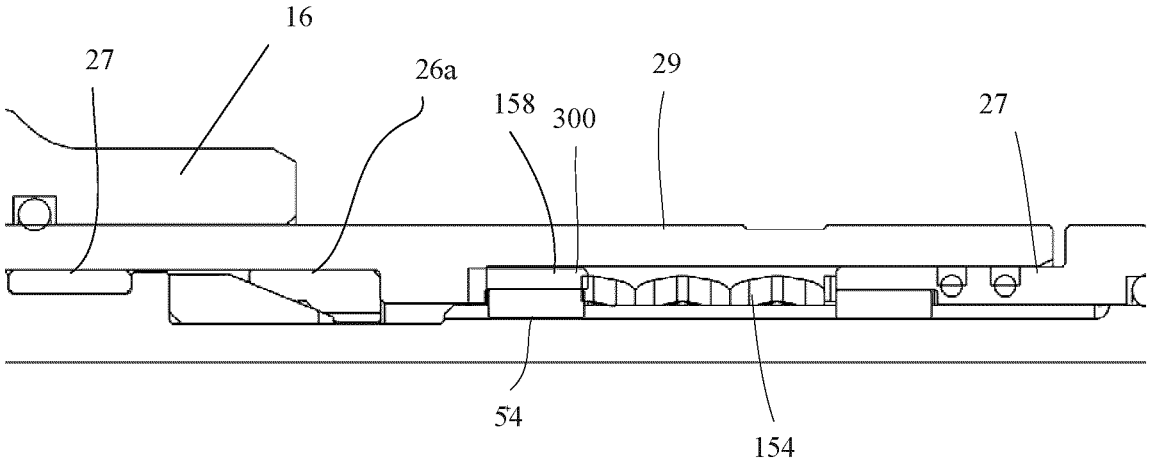
FIG. 13 is a cross-sectional side view of the rotating split tubing hanger of FIG. 4, showing a portion thereof in detail.

Referring to FIGS. 3, 4 and 13, rotating split tubing hanger 10 has a mandrel 12, which is connectable to tubing string 2 which is insertable into a well bore, and an outer sleeve 16 that is removably and rotatably mounted to mandrel 12 and housing sleeve 29. Between mandrel 12 and outer sleeve is 16 is housing sleeve 29 that has a housing sleeve inner surface 14 adjacent to mandrel 12, and a connecting portion 20 that is removably connectable to outer sleeve 16. As configured, housing sleeve 29 allows mandrel 12 to rotate within outer sleeve 16, while still allowing outer sleeve 16 to be removable relative to mandrel 12 and housing sleeve 29.

Referring to FIG. 4, connecting portion 20 is a threaded section on the outer surface of housing sleeve 29 and outer sleeve 16 has a complementary connecting portion 22 on an inner surface that is removably engageable with connecting portion 20. Referring to FIG. 3, outer sleeve 16 may have stops 24 that prevent rotation of the outer sleeve 16 relative to housing sleeve 29. As shown, stops 24 are set screws that engage engagement surface 32 to prevent rotation of outer sleeve 16 relative to housing sleeve 29 once installed. Other types of locks may also be used to prevent relative movement of housing sleeve 29 and outer sleeve 16. Mandrel 12 and outer sleeve 16 are configured such that, once outer sleeve 16 is threaded onto connecting portion 20 and set screws 24 installed, rotating split tubing hanger 10 is capable of bearing the load of tubing string 2 that may be connected below rotating split tubing hanger 10.

Outer sleeve 16 has a support surface 18 that acts as a load bearing shoulder and extends radially outward relative to housing sleeve 29 and mandrel 12. Support surface 18 is sized to engage a tubing head 132, as shown in FIGS. 1 and 2, in order to support housing sleeve 29, mandrel 12 and the attached tubing string 2 against downward axial movement. As there are a variety of designs for the wellhead equipment at surface, the term "tubing head" is used in a broad sense to include any device from which a tubing string may be hung or supported.

Figure 6:
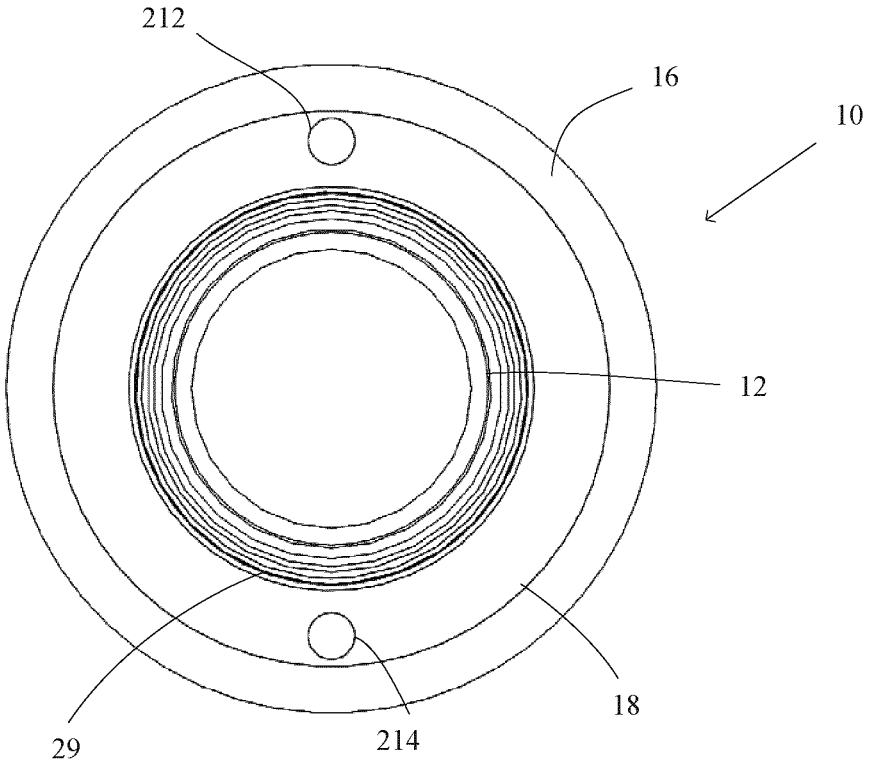
FIG. 6 is a top plan view of the rotating split tubing hanger of FIG. 3.
Figure 7:
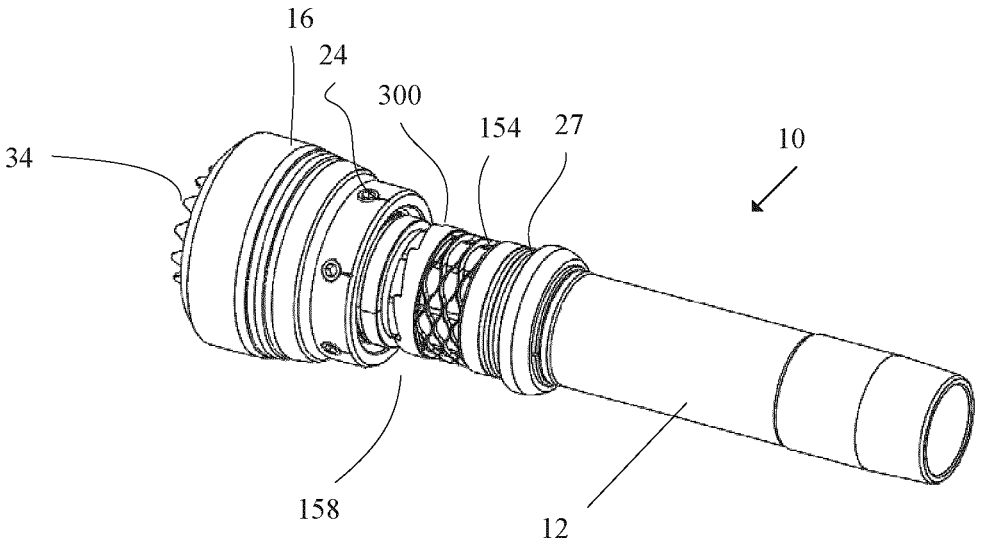
FIG. 7 is a partially cutaway perspective view of an alternative embodiment of a rotating split tubing hanger according to the invention with a clutch.
Figure 8:
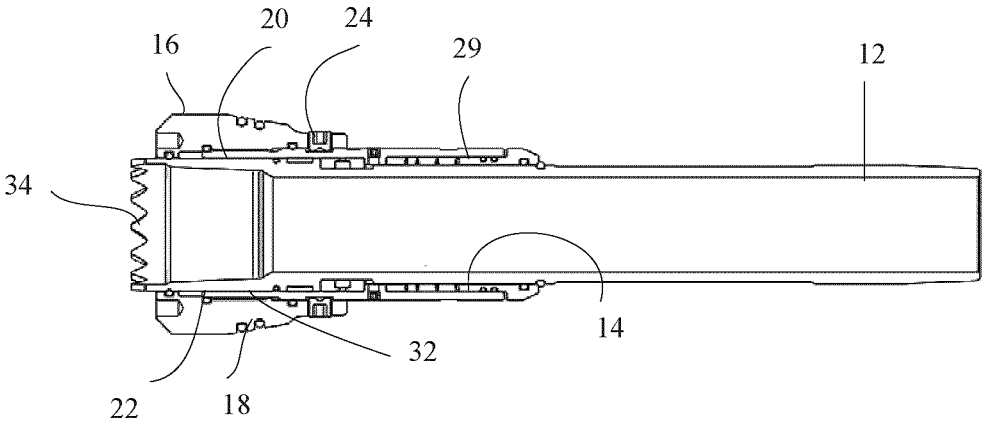
FIG. 8 is a cross sectional view of the rotating split tubing hanger of FIG. 7.
Figure 9:
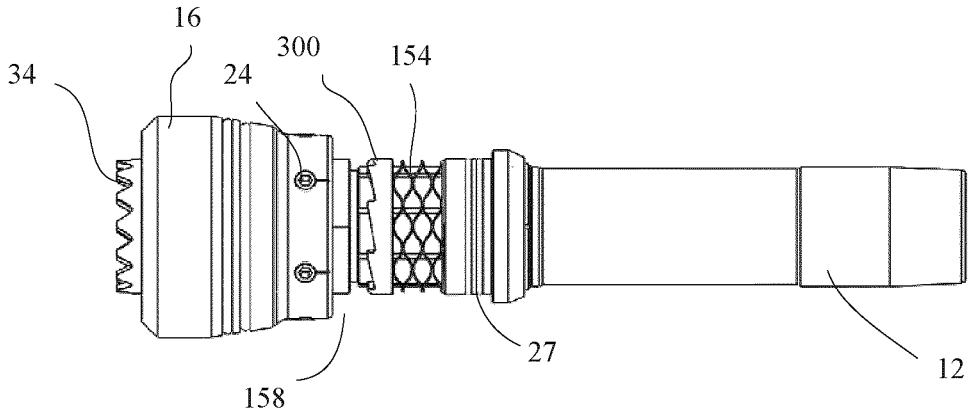
FIG. 9 is a partially cutaway side elevation view of the rotating split tubing hanger of FIG. 7.
Figure 10:
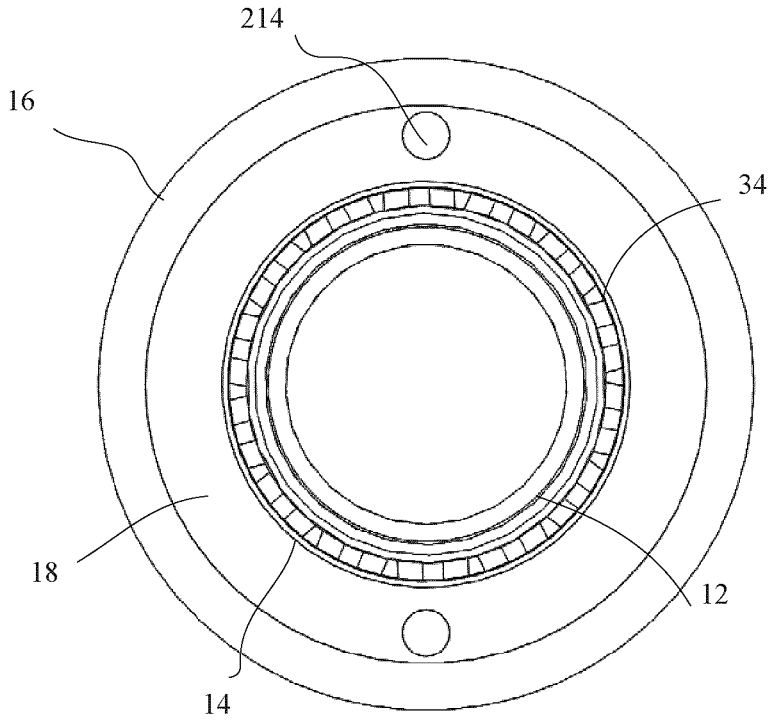
FIG. 10 is a top plan view of the rotating split tubing hanger of FIG. 7.
Figure 14:
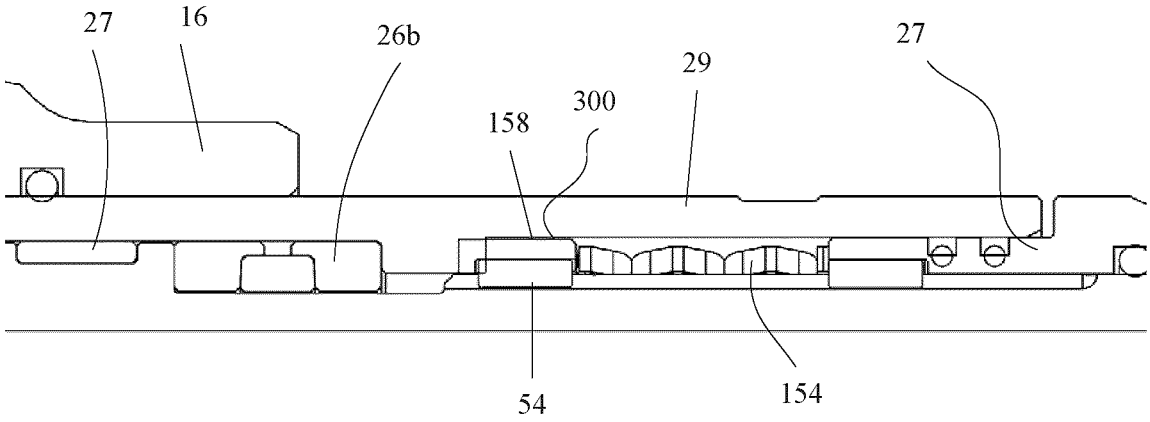
FIG. 14 is a cross sectional side view of the rotating split tubing hanger of FIG. 8, showing a portion thereof in detail.

Referring to FIG. 13, rotating split tubing hanger 10 allows an attached tubing string to rotate as the well is being produced. This is accomplished by providing housing sleeve inner surface 14 on housing sleeve 29 means to allow rotation of mandrel 12. Rotating split tubing hanger 10 includes bearings 26 and 27 that permit rotational movement of mandrel 12 relative to outer sleeve 16 and housing sleeve 29. Bearings 26 and 27, as shown in FIGS. 13 and 14, are housed between housing sleeve 29 and mandrel 12, and include a thrust bearing race 26 to support the axial load and a radial bearing race 27 to support against radial loads. Thrust bearing 26 may be a taper thrust bearing 26*a*, as shown in FIG. 13, or a flat face thrust bearing 26*b* as shown in FIG. 14. This configuration allows outer sleeve 16 to be secured to housing sleeve 29, and allows mandrel 12 to rotate relative to housing sleeve 29 while ensuring outer sleeve 16 does not move axially relative to mandrel 12. The relative movement of mandrel 12 to housing sleeve inner surface 14 of housing sleeve 29 may be accomplished in various ways, and that the arrangement of the bearings and support surfaces may be reconfigured by those skilled in the art. Outer sleeve 16 may include openings 214, as shown in FIG. 6, shaped and sized to receive a tool and allow for rotation or removal of outer sleeve 16.

Rotating split tubing hanger 10 may also be configured to rotate in a single direction. In order to accomplish this, rotating split tubing hanger 10 may be provided with a ratchet 158 that controls the direction of rotation of mandrel 12 to a single direction. As shown in FIGS. 5, 7, 9, 13, and 14, spring 154 is used to energize ratchet 158. Ratchet 158 has a first engagement surface 300 carried by housing sleeve 29, and a second engagement surface, such as pins 54, as shown in FIGS. 13 and 14, positioned on mandrel 12. Engagement surface 300 has teeth with a sloped side and a vertical side, such that rotation is permitted in one direction by the sloped sides sliding along pins 54, while the vertical side engages pins 54 which prevents rotation of mandrel 12 in the other direction. While this provides a relatively flat profile that takes little space between mandrel 12 and housing sleeve inner surface 14, other rotational control devices may also be used.

Referring to FIGS. 7 through 10, rotating split tubing hanger 10 may also be designed with a self-alignment locking clutch 34 that is carried by mandrel 12. Clutch 34 extends out above outer sleeve 16 such that it may be engaged from above. Clutch 34 allows mandrel 12 to be rotated by a user or locked against rotation, as required.

Mandrel 12 may be one piece and allows torque from the top to bottom of tubing string 2 and does not swivel. Mandrel 12 may rotate at any rate of rotation as provided by the torque, but as described above the rotation may be controlled to occur in only one direction. The rate of rotation of mandrel 12 may be controlled or uncontrolled.

Outer sleeve 16 may be configured to permit engagement with one or a plurality of different types of tubing head profiles, and provide access to a wellbore. Outer sleeve 16 may be replaceable to allow different configurations of outer sleeves to be attached to housing sleeve 29 and mandrel 12, depending on the requirements of the situation.

Figure 12:
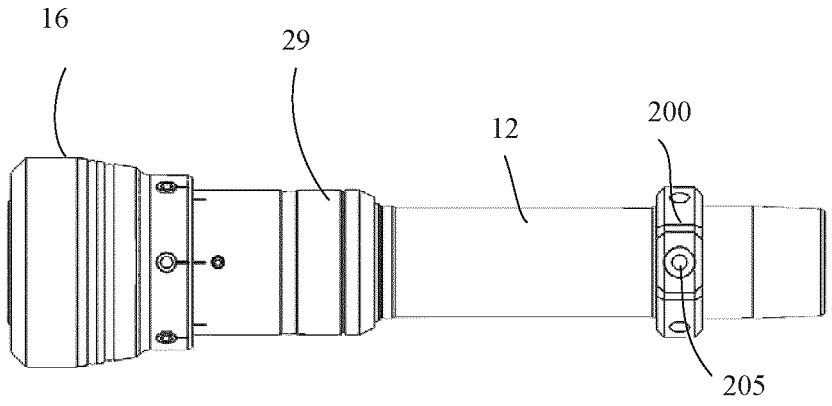
FIG. 12 is a side view of an embodiment of the invention including a magnetic ring.

Referring to FIG. 12, Rotating split tubing hanger may have a rotational indicator or counting device, such as magnetic ring 200 position on mandrel 12. Magnetic ring 200 comprises at least one magnet 205, which create a magnetic field measured by a sensor positioned on the casing which can determine when a rotation of mandrel 12 has occurred and record or transmit that occurrence on the surface.

In use, mandrel 12 is attached to tubing string 2 and the tubing string 2 inserted into the well, thereby permitting rotation of mandrel 12 with respect to housing sleeve 29 mounted on mandrel 12 so that a rotational torque applied to tubing string 2 through the operation of the downhole pump is transferred to mandrel 12 and mandrel 12 is rotated with respect to the housing sleeve 29 allowing rotation of the tubing string 2. Outer sleeve 16 can be connected to housing sleeve 29 using connecting portions 20, 22; and tubing string 2 suspended from the tubing head with outer sleeve 16, using support surface 18.

Figure 11:
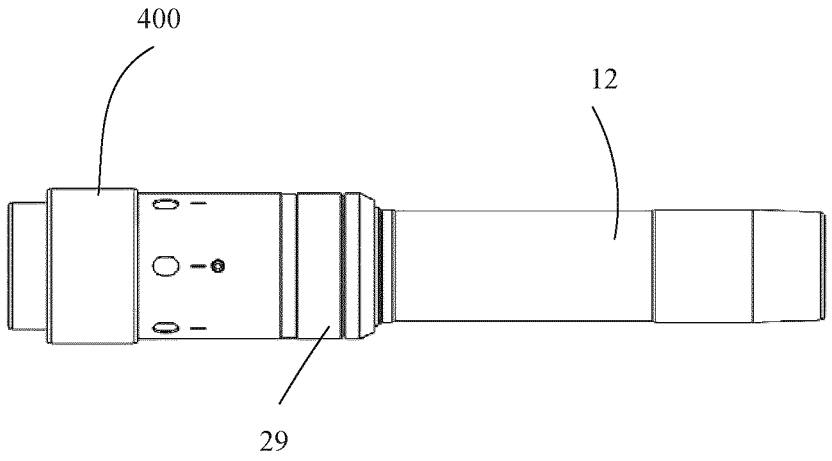
FIG. 11 is a side view of an embodiment of the invention including a protective sleeve.

The well can be accessed for servicing by lifting tubing hanger 10 out of engagement with the tubing head, then disconnecting outer sleeve 16 from housing sleeve 29 by separating the connecting portions 20, 22. Protective sleeve 400, as shown in FIG. 11, can then be placed on housing sleeve 29 and mandrel 12, then housing sleeve 29 and tubing string 2 can be lowered into the well, following which maintenance can be performed with tubing string 2. The maintenance may include rotating the complete tubing string, circulating fluid or gas through the tubing string and/or torqueing through the tubing string up to the maximum torque the tubing string will permit.

Further, in the methods taught herein, the various acts may be performed in a different order than that illustrated and described. Additionally, the methods can omit some acts, and/or employ additional acts.

These and other changes can be made to the present systems, methods and articles in light of the above description. In general, in the following claims, the terms used should not be construed to limit the invention to the specific embodiments disclosed in the specification and the claims, but should be construed to include all possible embodiments along with the full scope of equivalents to which such claims are entitled. Accordingly, the invention is not limited by the disclosure, but instead its scope is to be determined entirely by the following claims.

What is claimed is:

1. A rotating split tubing hanger for suspending a tubing string from a tubing head disposed on a producing well with a downhole pump disposed therein, the rotating split tubing hanger comprising:

a mandrel having an exterior surface, and further comprising an upper end and a lower end, the lower end configured for operatively coupling to the tubing string;

a housing sleeve mounted on the exterior surface of the mandrel, the housing sleeve disposed concentrically around the upper end of the mandrel;

an outer sleeve removably mounted on the housing sleeve, the outer sleeve being removably received over a top end of the housing sleeve, the outer sleeve disposed concentrically around both the top end of the housing sleeve and the upper end of the mandrel, the outer sleeve having a support surface that extends radially outward relative to the housing sleeve and forms a shoulder having a larger outer diameter than the housing sleeve, the support surface being sized to engage the tubing head and support the mandrel against downward axial movement; and wherein the housing sleeve inner surface is configured to permit continuous rotation of the mandrel and the tubing string, when the tubing string is operatively coupled to the mandrel, relative to the housing sleeve and the outer sleeve as rotational torque is applied to the tubing string due to operation of the downhole pump.

2. The rotating split tubing hanger of claim 1, wherein the housing sleeve comprises a first connecting portion, and the outer sleeve comprises a second connecting portion on an inner surface of the outer sleeve that is complementary to the first connecting portion.

3. The rotating split tubing hanger of claim 2, wherein the first and second connecting portions comprises first and second threaded portions, respectively.

4. The rotating split tubing hanger of claim 3, wherein the outer sleeve comprises a stop that is engageable with the housing sleeve to prevent relative rotation of the first and second threaded portions.

5. The rotating split tubing hanger of claim 1, wherein the housing sleeve inner surface supports one or more bearing races.

6. The rotating split tubing hanger of claim 5, wherein the bearing races are housed between the housing sleeve and the mandrel.

7. The rotating split tubing hanger of claim 1, further comprising a rotational control element between the mandrel and the housing sleeve that permits rotation of the mandrel only in a single direction relative to the outer sleeve.

8. The rotating split tubing hanger of claim 7, wherein the rotational control element is a ratchet.

9. The rotating split tubing hanger of claim 1, wherein the outer sleeve has an outer surface adapted to form a positive seal against pressure when installed in the tubing head.

10. The rotating split tubing hanger of claim 1, wherein the mandrel is one piece.

11. The rotating split tubing hanger of claim 1, further comprising a rotational indicator.

12. The rotating split tubing hanger of claim 11, wherein the rotational indicator is a magnet positioned on the mandrel positioned in a ring on the mandrel.

13. A method of hanging tubing, the method comprising the steps of:

providing a rotating split tubing hanger as claimed in claim 1;

connecting the mandrel to the tubing string and inserting the tubing string into the producing well such that the rotating split tubing hanger is supported by the tubing head;

permitting the mandrel to rotate with the tubing string;

lifting the rotating split tubing hanger out of engagement from the tubing head;

disconnecting the outer sleeve from the housing sleeve; and lowering the mandrel, housing sleeve, and the tubing string into the producing well.

14. The method of claim 13, further comprising the step of when the rotating split tubing hanger is above the tubing head and removed from the housing sleeve, providing access to the tubing string in a well bore below the tubing head.

15. The method of claim 13 further comprising connecting a protective sleeve to the housing sleeve after disconnecting the outer sleeve from the housing sleeve.

16. The method of claim 13 further comprising performing maintenance with the tubing string.

17. The method of claim 16 wherein the maintenance comprises at least one of: rotating the tubing string; circulating a gas or fluid through the tubing string; and torqueing through the tubing string.

18. A rotating split tubing hanger for suspending a tubing string from a tubing head disposed on a producing well with a downhole pump disposed therein, the rotating split tubing hanger comprising:

a mandrel having a bore therein and a mandrel exterior surface, the mandrel further comprising an upper end and a lower end, the lower end of the mandrel attachable to the tubing string;

a housing sleeve mountable on the exterior surface of the mandrel, the housing sleeve disposed concentrically around the upper end of the mandrel, the mandrel and the tubing string, when attached to the lower end of the mandrel, being continuously rotatable relative to the housing sleeve as rotational torque is applied to the tubing string due to operation of the downhole pump, and the housing sleeve comprising a housing sleeve exterior surface; and an outer sleeve removably mountable on the housing sleeve exterior surface, the outer sleeve being removably received over a top end of the housing sleeve, the outer sleeve disposed concentrically around both the top end of the housing sleeve and the upper end of the mandrel, the outer sleeve comprising an outer sleeve exterior support surface engageable with the tubing head, the exterior support surface forming a shoulder having a larger outer diameter than the housing sleeve.

19. The rotating split tubing hanger of claim 18, wherein the outer sleeve further comprises an outer sleeve interior surface reversibly mateable with the housing sleeve exterior surface.

20. The rotating split tubing hanger of either claim 18, further comprising one or more bearings positioned between the mandrel and the housing sleeve to facilitate rotation of the mandrel within the housing sleeve.

* * * * *